US005213213A

United States Patent [19]

Bunin

[11] Patent Number: 5,213,213

[45] Date of Patent: May 25, 1993

[54] MEDICATION CONTAINER

[75] Inventor: Leonid Bunin, Woodbridge, N.J.

[73] Assignee: Merck & Co., Inc., Rahway, N.J.

[21] Appl. No.: 867,588

[22] Filed: Apr. 13, 1992

[51] Int. Cl.[5] ..... B65D 83/04

[52] U.S. Cl. ..... 206/535

[58] Field of Search ..... 206/534.1, 534.2, 535, 206/536, 537, 540

[56] References Cited

U.S. PATENT DOCUMENTS 2,935,180 5/1960 Von Martens ..... 206/535

3,896,968 7/1975 Pehr ..... 206/535 X 4,911,291 3/1990 Iwata et al. ..... 206/535 X

*Primary Examiner*—William I. Price

*Attorney, Agent, or Firm*—Salvatore C. Mitri; Frank P. Grassler; Charles M. Caruso

[57] ABSTRACT

There is disclosed a medication container which is adapted to be side loaded with unit doses of medication during packaging operations. After being filled with the unit doses of medication, the container side is sealed. The medication doses can be removed by a user from the sealed container by means of a removable closure at one end of the container.

2 Claims, 1 Drawing Sheet

MEDICATION CONTAINER

BACKGROUND OF THE INVENTION

Unit doses of medication that are prepared in the form of tablets, capsules, caplets, and the like, are generally packaged in bottles which are typically loaded or filled into the bottle through its neck. After being thusly loaded or filled, the bottles are usually closed with a removable cap means so that a patient can access the medication.

Unit doses of medication that are provided in the form of tablets, capsules, caplets, and the like, are often prepared in different geometric forms such as square, rectangular, triangular, trapazoidal, spherical, round, oblong, elliptical, and the like, in order to distinguish one unit dose of medication from a different unit dose of the same medication and to distinguish different medications from one another.

Loading or filling bottles through their necks with such unit doses of medication requires the use of specialized and sophisticated equipment since the medication units are typically individually loaded into the bottles. In many instances, the speed at which an automated packaging line is run must be reduced to insure proper loading of the bottles of these medication units.

SUMMARY OF THE INVENTION

It has now been found that these short comings of loading bottles through their necks with unit doses of medications that require costly packaging equipment and often interfere with automated on-line packaging schedules are overcome by use of the medication container of this invention.

In general, the medication container of the invention comprises an elongated body having a closed end and an open end and is adapted to receive and accommodate unit doses of medication of different sizes and shapes; a removable closure means to close the open end of said container; an elongated opening formed in the wall of said container, said opening being substantially parallel to the longitudinal axis of said container; and, means to cover and seal said opening after said container has been loaded with unit doses of medication.

The geometric form of the medication container is not critical but for ease of manufacture and to minimize cost, it is preferably tubular or rectangular. The means to removably close the open end of the container is also not critical and conventional, removable closure means such as screw caps, snap fitted caps, and the like can be readily used.

Similarly, the material used to cover and seal the elongated opening after the container has been loaded or filled with the unit doses of medication is not critical, but it should be such that once sealed to the container body over the elongated opening it is difficult to remove. Conventional materials such as heat sealable aluminum foils, plastics, aluminum foil-plastic laminates, and the like, can be employed for this purpose.

Although the medication container of the invention can be made from any suitable material, moldable plastics such as high or low density polyethylene, polypropylene, and the like, are preferred as they are readily moldable and economic.

DETAILED DESCRIPTION OF THE INVENTION

The medication container of the invention will become more apparent from the ensuing description when considered together with the accompanying drawing wherein.

Figure 1:
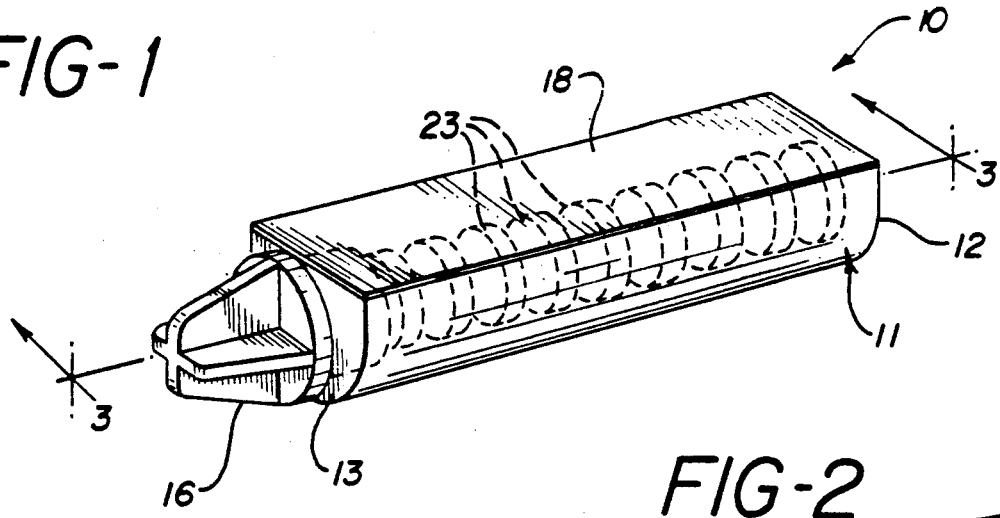
FIG. 1 is a perspective view of the medication container of the invention.
Figure 2:
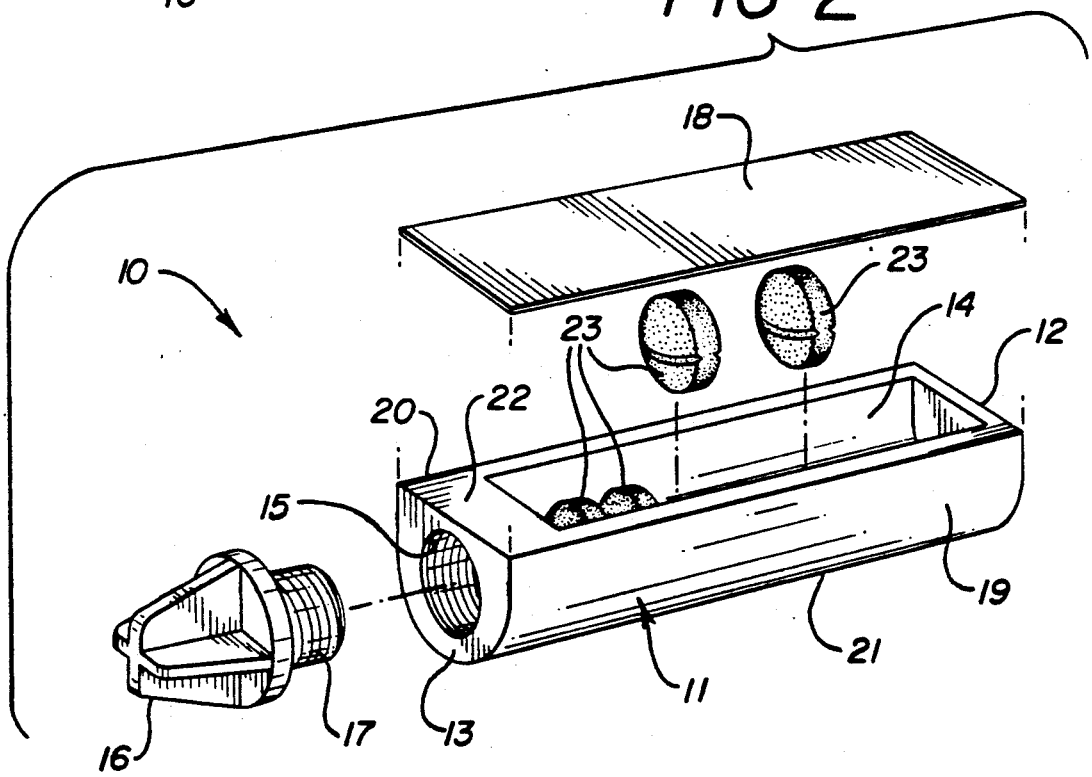
FIG. 2 is a exploded, perspective view of the container shown in FIG. 1; and, FIG. 3 is a side elevation of the container taken substantially on the line 3—3 of FIG. 1.
Figure 3:
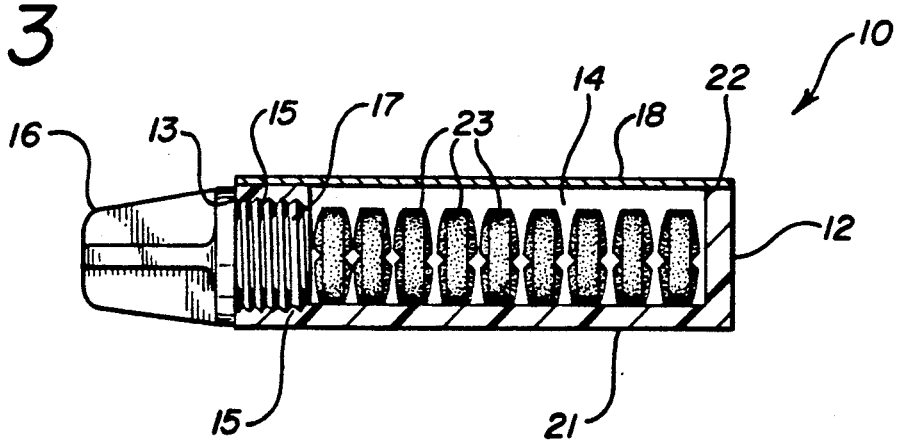

Turning now to the drawing, wherein like reference numerals denote like parts, there is shown in FIGS. 1–3 the medication container of the invention generally indentified by reference numeral 10. The body 11 of container 10 has a closed end 12, and an opposed open end 13. An elongated opening 14 is formed in the wall of the body 11 which is substantially parallel to the longitudinal axis of body 11. In the embodiment illustrated, open end 13 carries internal threads 15 to receive a removable cap 16 having external threads 17. A cover means 18 is employed to overlay the elongated opening 14 and is sealed to the body 11 of container 10 in the area defining the periphery of elongated opening 14.

As best seen in FIG. 2, the geometric form of the medication container 10 illustrated in the drawings is rectangular having, in addition to ends 12 and 13, opposed side walls 19, 20, a bottom wall 21 and a top wall 22 in which elongated opening 14 is formed.

Prior to filling and loading medication container 10, removable cap 16 is threadably screwed into open end 13 so that both ends of container 10 are closed during the filling and loading operation. During automated filling and loading operation, container 10 is conveyed to one or more filling and loading stations by such means as conventional conveyor belts. At the filling and loading stations, a pre-determined number of unit doses of medication, here shown in the form of tablets 23, (FIGS. 2 and 3), are all deposited concurrently into container 10; i.e., in a single one-drop operation. Once the container 10 has been loaded with the medication, it is conveyed to a station where cover means 18 is placed to overlay elongated opening 14. Cover means 18 can then be sealably secured to the top wall 22 such as by heat sealing at the same station or be conveyed to another station to be sealably secured.

To access the medication in the container 10, a patient would unscrew and remove cap 16 and remove that quantity of unit dose medication needed.

Thus, the medication container of the invention provides several significant advantages over conventional bottles currently used. For example, the medication container permits loading of the entire predetermined number of medication units as a one load drop as opposed to loading bottles through their necks with individual medication units. No additional packing is required at the dispensing end of the medication container of the invention whereas bottles generally require some type of packing such as cotton to fill in empty head space. The relatively narrow opening at the dispensing end of the medication container of the invention permits a user to readily extract individual medication units separately as opposed to shaking out an individual medication unit from the conventional, wide mouth opening of bottles thereby making it more convenient for a user and minimizing contamination of the medication units that may be caused by frequent user handling.

While the medication container of the invention has been described in some detail and with particularity, it will be appreciated by those skilled in the art that changes and modifications can be made therein without departing from the scope of the invention defined in the claims.

What is claimed is:

1. A medication container comprising:

(a) an elongated container body having a closed end and an open end, said container body adapted to receive and accommodate unit doses of medication having different sizes and shapes;

(b) a removable closure means to close said open end, said removable closure means having an externally threaded cap member adapted to be threadably screwed into internal threads formed in said open end;

(c) an elongated opening formed in the wall of said container body, said opening being substantially parallel to the longitudinal axis of said container body; and, (d) cover means to overlay said elongated opening and seal said container.

2. The medication container of claim 1 wherein the geometric form of said container is rectangular and includes opposed side walls, a bottom wall and a top wall in which said elongated opening is formed.

* * * * *